United States Patent [19]

Yoneyama et al.

[11] Patent Number: 4,916,054

[45] Date of Patent: Apr. 10, 1990

[54] SILVER HALIDE PHOTOGRAPHIC ELEMENT CONTAINING A COATING AID

[75] Inventors: Masakazu Yoneyama; Jun Arakawa, both of Kanagawa, Japan

[73] Assignee: Fuji Photo Film Co., Ltd., Kanagawa, Japan

[21] Appl. No.: 171,362

[22] Filed: Mar. 21, 1988

[30] Foreign Application Priority Data

Mar. 20, 1987 [JP] Japan ..... 62-67507

[51] Int. Cl.[4] ..... G03C 1/02

[52] U.S. Cl. ..... 430/636; 430/529; 430/637

[58] Field of Search ..... 430/529, 636, 637

[56] References Cited

U.S. PATENT DOCUMENTS

| | | | |
|---|---|---|---|
| 3,525,620 | 8/1970 | Nishio et al. | 430/636 |
| 3,788,850 | 1/1974 | Decat et al. | 430/636 |
| 3,788,851 | 1/1974 | Willems et al. | 430/636 |
| 4,105,453 | 8/1978 | Numata et al. | 430/636 |
| 4,192,683 | 3/1980 | Sakamoto et al. | 430/636 |

FOREIGN PATENT DOCUMENTS 62-279330 12/1987 Japan .

OTHER PUBLICATIONS

Stirton et al., Journal of the American Oil Chemists Society, vol. 43, pp. 157–160.

*Primary Examiner*—Jack P. Brammer

*Attorney, Agent, or Firm*—Sughrue, Mion, Zinn, Macpeak & Seas

[57] ABSTRACT

Disclosed is a silver halide photographic material having at least one light-sensitive silver halide emulsion layer on a support and containing, in the silver halide emulsion layer or in any other hydrophilic colloid layer, a coating aid of a general formula (I):

$$A—O—X—(B)_n—SO_3M \quad (I)$$

wherein

X represents $—(CH_2CH_2O)_a—(C_3H_6O)_b—$;

a represents 0 or from 1 to 50 on the average;

b represents from 1 to 5 on the average;

A represents an alkyl or alkenyl group having from 8 to 25 carbon atoms, or an aryl group;

B represents a divalent linking group;

n represents 0 or 1; and

M represents a cation. Because of the incorporation of the coating aid, the coating compositions can be uniformly coated on the support with neither comet nor repelling. The photographic light-sensitive material therefore does not stain the photographic material, the processing solution and the rollers during the processing of the material, and, additionally, the material is free from static marks by static electricity.

5 Claims, No Drawings

SILVER HALIDE PHOTOGRAPHIC ELEMENT CONTAINING A COATING AID

FIELD OF THE INVENTION

The present invention relates to a silver halide photographic material containing a coating aid in the hydrophilic organic colloid-coating layer of the material, and in particular, to a photographic material which is free from development blurs, staining of processing solutions and problems caused by staining substances (drying unevenness, staining of films by adhesion of the staining substances to conveyor rollers, etc.).

BACKGROUN OF THE INVENTION

As is well known, photographic light-sensitive materials are composed of plural hydrophilic colloid (generally gelatin) layers coated on a support such as paper, etc. These layers have various functions, for example, as a subbing layer, and interlayer, a light-sensitive layer, a protective layer, etc., and these contain various inorganic or organic additives so as to satisfy the respective functions.

Thus, general photographic light-sensitive materials have a number of hydrophilic organic colloic layers, and for the manufacture of such materials, uniform and rapid coating of the respective coating compositions on the support without any coating problems such as comets, repelling, coating unevenness, etc., is required to form a thin film on the support (the terms "comet" and "repelling" are mentioned in detail hereunder).

Regarding the coating system, a continuous and simultaneous multilayer coating method has been used much lately.

The most difficulty in conducting the coating step has been encountered in the manufacture of color photographic materials. In the manufacture of color photographic materials, a lot of hardly water-soluble additives such as color couplers, ultraviolet absorbents, brightening agents, etc. are dissolved in high boiling point organic solvents such as phthalate series compounds, phosphate series compounds, etc., and the resulting solution is dispersed (by so-called emulsification) in a hydrophilic organic colloid, such as a gelatin solution, in the presence of a surfactant so as to incorporate the additives into the hydrophilic organic colloid layers. If, however, a large amount of a surfactant is used as the emulsifier for the incorporation of the additives into the hydrophilic organic colloid layer, it would become difficult to coat another hydrophilic organic colloid layer onto the hydrophilic organic colloid layer. If, on the other hand, the amount of the emulsifier used is made small, the photographic characteristics of the resulting photographic light-sensitive material would become unstable.

Various kinds of anionic surfactants have heretofore been used as coating aids for various coating compositions for photographic light-sensitive materials, and specific examples of such coating aids are described in U.S. Pat. Nos. 2,240,476, 3,026,202, 3,068,101, 3,220,847 and 3,415,649, British Patent No. 1,259,398, etc.

In addition, forming the constitutional layers of photographic light-sensitive materials by coating an aqueous hydrophilic colloid solution containing a dispersion of a hydrophobic synthetic polymer substance (such as acryltese on a support has been widely employed. Also in such case, it is indispensable to use surfactants as an emulsification and dispersion aid.

However, when a colloid solution such as a gelatin solution is to be coated on a colloid layer, such as a gelatin layer, in the presence of the anionic surfactant as a coating aid, the solubility of the anionic surfactant would decrease to an extreme extent, because of the alkaline earth metal ions, such as calcium ion, contained in the gelatin. Therefore, the addition of the anionic surfactant to the gelatin-coating solution, which would cause the precipitation of a hydrated solid substance form the surfactant to noticeably deteriorate the coating capacity of the coating solution, is unacceptable.

When a cationic antistatic agent to be used for static charge prevention, for example, the cationic surfactants described in U.S. Pat. No. 3,850,642, Japanese Patent Application (OPI) No. 146248/82 (the term "OPI" as used herein means a "published unexamined Japanese patent application"), etc., and the cation polymers described in Japanese Patent Application (OPI) Nos. 7763/80, 92125/78, 18728/79, etc., is used together with the above-mentioned anionic surfactant as a coating aid in the same photographic light-sensitive material, the two would form a hardly soluble complex, particularly when these are added to the same coating composition, to cause the generation of comets in the resulting photographic light-sensitive material. Such is a serious defect.

On the other hand, even if any of the coating aids and the emulsification and dispersion aids is added to a different layer from that containing the antistatic agent, these would dissolve out from the photographic light-sensitive material into the processing solution during the development of the material and, accordingly, would form an insoluble complex in the processing solution which would also cause processing unevenness. Such is also problematic.

Recently, it has been suggested to reduce the amount of the rinsing water used during the processing of photographic light-sensitive materials, from the viewpoint of preservation of the environment, water resources, cost, simplification of processing instruments, etc. In addition, a method of using a solution containing various kinds of chemical agents so as to reduce the amount of the processing solution to be used has been proposed, in place of the rinsing step using water only (for example, refer to Japanese Patent Application (OPI) Nos. 8542/82, 14834/83, 132146/82, 18631/83, 184345/84, 197540/82, 134636/83, etc.). In such cases of reducing the amount of the rinsing water or using chemical agents, it is known that the surfactant dissolved out from the photographic materials being processed would unevenly remain on the film surface to cause discoloration of the film after a lapse of time, or the high boiling point solvents, the couplers, etc., dispersed in the coated film would flocculate to cause the acceleration of a so-called sweating phenomenon derived from the flocculation.

In addition, it has also been tried, recently, to reduce the amount of the replenisher during processing from the viewpoint of the processing cost, and also in this case, the proportion of the surfactant deposited in the processing solution is apt to increase. Accordingly, when the photographic material containing the conventional anionic surfactant is continuously processed by such a method using a reduced amount of the replenisher, some tar-like insoluble substances are apt to be formed problematically.

Further, use of a more concentrated processing solution so as to shorten the processing time has also been tried, which, however, also has the same problems as mentioned above.

A method has been known where a bleaching accelerator is added to a bleaching solution or bleach-fixing solution so as to shorten and simplify the processing time (Japanese Patent Application (OPI) Nos. 95630/78 and 192953/82, Japanese Patent Publication No. 12056/79, U.S. Pat. No. 4,552,834, etc.). However, it has been found that the bleaching accelerator and the anionic surfactant dissolved out from the photographic light-sensitive material being processed form some insoluble complexes which stain the processing solution.

Japanese Patent Application (OPI) No. 98235/79 discloses that the addition of an alkaline earth meatal salt of a certain kind of anionic surfactant to which an ethylene oxide has been introduced to a coating composition is effective for improving the coating capacity of the composition, even when the composition contains an alkaline earth metal ion such as calcium ions in the gelatin. In fact, when the alkaline earth metal salt of the anionic surfactant is used, some problems during coating, such as repelling, etc., may decrease and the coating capacity may be somewhat improved, as compared with other conventional anionic surfactants, but the metal salt still does not satisfy the need for rapid coatability which is recently being required in the manufacture of silver halide photographic materials.

In addition, the problems of staining of processing solutions, staining of photographic materials because of the adhesion of staining substance to conveyor rollers, etc., could not be overcome by any prior art techinques.

The generation of these problems is caused either by the property of the surfactants themselves to be used for the respective purposes or by the interaction between the surfactants and the co-existing other additives.

Accordingly, in order to overcome these problems, it is considered best to improve the respective surfactants to be used, but in fast, such improvement would mostly damage the intrinsic capacity of the surfactants themselves and therefore is accompanied by extreme difficulties.

SUMMARY OF THE INVENTION

A first object of the present invention is to provide a photographic light-sensitive material with a uniform coating on a support. When a gelatin-containing composition or any other hydrophilic colloid composition is coated on a support, such as film, paper, etc., or on any other photographic layer, according to the present invention, the composition can be uniformly coated with neither "comet" nor "repelling".

The term "comet" means the phenomenon of locally forming non-coated parts of the nuclei and the surroundings thereof of tracws of fat and oil grains, mineral oil grains, hydrophobic liquids and solids, etc., contained in the coating composition.

The term "repelling" means the phenomenon of locally forming non-coated parts because of the insufficient diffusion of the coating composition which would mainly be caused by the surface tension of the composition.

A second object of the present invention is to provide a photographic light-sensitive material which does not stain the development processing solution and the rollers used during the processing of the material.

A third object of the present invention is to provide a photographic light-sensitive material which is free from any static marks caused by static electricity during the coating and drying step, picture-taking step and transportation before the processing of the material.

The objects of the present invention can be attained by the incorporation of a compound of a general formula (I) below into the silver halide emulsion layer or in any other hdyrophilic collid layer of the photographic light-sensitive material.

$$A—O—X—(B)_n—SO_3M \qquad (I)$$

wherein

X represents $—(CH_2CH_2O)_a—(C_3H_6O)_b—$;

a represents 0 or from 1 to 50 on the average;

b represent from 1 to 5 on the average;

A represents an alkyl or alkenyl group having from 8 to 25 carbon atoms, or an aryl group;

B represents a divalent linking group;

n represents 0 or 1; and

M represents a cation.

DEATILED DESCRIPTION OF THE INVENTION

In formula (I), the alkyl group or the alkenyl group represented by A can be a straight or branched chain, substituted or unsubstituted group and preferably contains from 10 to 20 carbon atoms. The aryl group represented by A can be a monocyclic or polycyclic, substituted or unsubstituted aryl group and preferably contains from 6 to 16 carbon atoms. Examples of substitutents for the alkyl and alkenyl groups include an alkanoylamino group, and examples of substituents for the aryl group include an alkanoylamino group and alkyl group. Preferred examples of A include $C_{12}H_{25}$—, $C_{16}H_{33}$—, $C_6H_{13}CH(C_8H_{17})CH_2$—, $C_{10}H_{21}CH(C_8H_{17})CH_2$—, $C_{18}H_{35}$—,

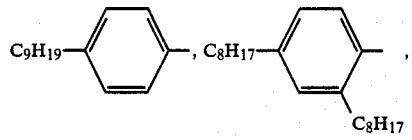

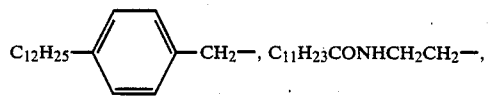

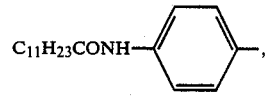

etc. In particular, a branched chain alkyl group is especially preferred.

In formula (I), B represents a divalent linking group of a straight or branched chain alkylene or carbonylalkylene group.

Preferred examples of B include $—CH_2—CH_2—$, $—(CH_2)_4—$, $$-\underset{\underset{CH_3}{|}}{CH_2CH_2CH_2}-,\ -\underset{\underset{O}{\|}}{C}CH_2-,$$

etc.

In formula (I), M represents a cation such as an alkali metal, an alkaline earth metal, ammonium or a quaternary amine cation. Preferred examples of M include Na, K, Mg, $NH_4$, $N(CH_3)_4$, etc.

Preferred examples of the compounds for use in the present invention are described below, which, however, are not limitative.

$$C_6H_{13}\underset{\underset{C_8H_{17}}{|}}{C}HCH_2O(C_3H_6O)_mSO_3Na \quad m \approx 1$$ No. 1

$$C_6H_{13}\underset{\underset{C_8H_{17}}{|}}{C}HCH_2O(C_3H_6O)_mSO_3Na \quad m \approx 2$$ No. 2

$$C_6H_{13}\underset{\underset{C_8H_{17}}{|}}{C}HCH_2O(C_3H_6O)_m(CH_2)_4SO_3Na \quad m \approx 2$$ No. 3

$$C_6H_{13}\underset{\underset{C_8H_{17}}{|}}{C}HCH_2O(CH_2CH_2O)_l(C_3H_6O)_mSO_3Na \quad l \approx 3 \quad m \approx 3$$ No. 4

$$C_{12}H_{25}O(C_3H_6O)_mSO_3Na \quad m \approx 2$$ No. 5

$$C_{12}H_{25}O(C_3H_6O)_m(CH_2)_4SO_3Na \quad m \approx 2$$ No. 6

$$C_{16}H_{33}O(CH_2CH_2O)_l(C_3H_6O)_mSO_3Na \quad l \approx 10 \quad m \approx 5$$ No.7

$$C_{18}H_{37}O(CH_2CH_2O)_l(C_3H_6O)_mSO_3N(C_2H_5)_4 \quad l \approx 30 \quad m \approx 5$$ No. 8

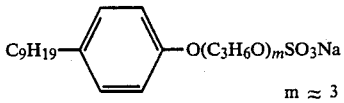

$m \approx 3$ No. 9

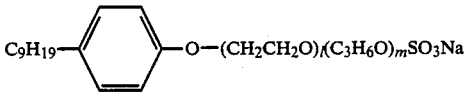

$l \approx 3 \quad m \approx 2$ No. 10

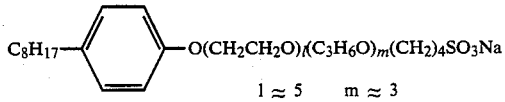

$l \approx 5 \quad m \approx 3$ No. 11

$$C_{10}H_{21}\underset{\underset{C_8H_{17}}{|}}{C}HCH_2O(CH_2CH_2O)_l(C_3H_6O)_mSO_3Na \quad l \approx 10 \quad m \approx 3$$ No. 12

$$C_{16}H_{33}O(C_3H_6O)_mSO_3Na \quad m \approx 1$$ No.13

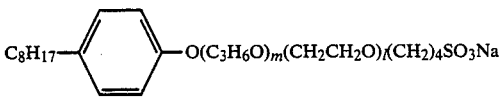

$l \approx 3 \quad m \approx 2$ No. 14

-continued $$C_6H_{13}\underset{\underset{C_8H_{17}}{|}}{C}HCH_2O(C_3H_6O)_m(CH_2CH_2O)_l(CH_2)_4SO_3Na \quad l \approx 3 \quad m \approx 1$$ No. 15

$$C_6H_{13}\underset{\underset{C_8H_{17}}{|}}{C}HCH_2O(CH_2CH_2O)_l(C_3H_6O)_m(CH_2)_4SO_3Na \quad l \approx 3 \quad m \approx 2$$ No. 16

$$C_6H_{13}\underset{\underset{C_8H_{17}}{|}}{C}HCH_2O(CH_2CH_2O)_l(C_3H_6O)_m(CH_2)_4SO_3Na \quad l \approx 10 \quad m \approx 2$$ No. 17

$$C_6H_{13}\underset{\underset{C_8H_{17}}{|}}{C}HCH_2O(CH_2CH_2O)_l(C_3H_6O)_m(CH_2CH_2O)_n(CH_2)_4SO_3Na \quad l \approx 2 \quad m \approx 2 \quad n \approx 2$$ No. 18

$$C_{10}H_{21}\underset{\underset{C_8H_{17}}{|}}{C}HCH_2O(CH_2CH_2O)_l(C_3H_6O)_m-\underset{\underset{O}{\|}}{C}CH_2SO_3Na \quad l \approx 5 \quad m \approx 2$$ No. 19

$$C_{12}H_{25}\underset{\underset{C_{10}H_{21}}{|}}{C}HCH_2O(CH_2CH_2O)_l(C_3H_6O)_mSO_3Na \quad l \approx 10 \quad m \approx 3$$ No. 20

The compounds of the formula (I) have various favorable characteristics in that these compounds have a large surface tension-lowering capacity and the C.M.C. (critical micelle concentration) thereof is low, the coating composition containing the compound is free from the comet problem which would be caused by the formation of the insoluble complex with calcium ion, and the photographic film containing the compound does not form any staining substances when processed in a development processing solution. The reasons are presumed to result from the special chemical structure of the compound which contains a low molecular weight polyoxypropylene group in the molecule and the surface active behavior on the basis of the structure thereof.

The compounds of the formula for use in the present invention can be produced by a general method. For example, they can be produced by a general method. For example, they can be produced by the method described in *Journal of the Americal Oil Chemists Society*, Vol. 43, page 157. Some production examples are mentioned below. Unless otherwise indicated herein, all parts, percents, ratios and the like are by weight.

PRODUCTION EXAMPLE 1

Production of Compound No. 1

Addition of Propylene Oxide 242 g of 2-hexyldecanol and 9.7 g of soudim hydroxide were put in a 500 ml flask having a stirrer, a reflux condenser, a thermometer and a dropping funnel, and heated and stirred at 150° C. Propylene oxide was dropwise added thereto under continuous reflux at 150° to 160° C., while the amount of the propylene oxide dropwise added was adequately adjusted. After the completion of the reaction, the non-reacted propylene oxide was removed, and the mean molar amount of the propylene oxide added was calculated from the increase in the weight of the product (n was found to be 1.1). The reaction mixture was cooled to room temperature and neutralized with concentrated hydrochloric acid. This reaction mixture was dissolved in diethyl ether and the inorganic salts were removed by washing with water. The ether was distilled off, and the residue was distilled under reduced pressure in a five-stage column rectification tower. The fraction having a boiling point of 140° to 140° C./1 mmHg was collected (yield: 23%), and the composition distribution thereof was examined by gas chromatography. As a result, the fraction was confirmed to comprise n=0, 0.1%; n=1, 85.1%; n=2, 14%; and n=3, 0.8%, and the mean number of n was 1.1.

Sulfation 30 g of the above-mentioned propylene oxide adduct and 50 ml of carbon tetrachloride were put in a 300 ml flask having a stirrer, a thermometer, a calcium chloride tube and a dropping funnel, dissolved and cooled with ice, and then 13.5 g of chlorosulfonic acid was dropwise added to thereto at 5° C. or below. The whole was stirred for 30 minutes at said temperature and then for further 30 minutes at room temperature. 80 ml of ethanol was added for dilution, and the thus diluted solution was neutralized with an aqueous 50% sodium hydroxide solution. After the solvent was distilled off under reduced pressure, the residue was re-dissolved in ethanol and the undissolved inorganic salts were taken out by filtration. The ethanol was distilled off, and the thus-concentrated solution was added to acetonitrile to obtain a precipitate. On the other hand, the acetonitrile solution was concentrated and washed with hexane to obtain a waxy solid. The both were confirmed to be the desired products by IR and NMR. The surface tension (1%) was 25.7 dyne/cm.

In the practice of the present invention, the compounds of the formula (I) can be added to a hydrophilic organic colloid-coating composition for use as a coating aid. The amount of the compound to be added for use may be from 0.01 to 50 g, preferably from 0.05 to 5 g, per kg of the coating composition. For the addition, the compound is preferably added to the composition in the form of a solution in water or methanol or any other water-miscible solvent. The above-mentioned surfactants can be added to any coating composition which forms a photographic layer to constitute a photographic light-sensitive material, irrespective of whether the layer is a light-sensitive layer or a non-light-sensitive layer.

In the manufacture of the photographic light-sensitive materials of the present invention, an extremely uniform hydrophilic colloid coating can be formed not only by low speed coating but also by high speed coating, because of the incorporation of the compound of formula (I). Specifically, neither coating uneveness nor comet and repelling of coating occurs during the coating operation.

The technique of the present invention is especially useful when olephilic substances such as couplers, alkylhydroquinones, ultraviolet absorbents, sensitizing dyes, etc. and hydrophobic vinyl polymers are incorporated into photographic light-sensitive materials.

Specifically, a solution obtained by dissolving the oleophilic substance in a hardly water-soluble high boiling point organic solvent is finely and stably dispersed in an aqueous hydrophilic colloid solution in the presence of the surfactant of the above-mentioned general formula (I) and the resulting dispersion is directly used as a coating composition; or the disperison may be added to a different coating composition such as a photographic emulsion, etc.

On the other hand, the surfactants of the present invention are also effective in the preparation of an aqueous dispersion of a hydrophobic vinyl polymer. Specifically, a hydrophobic vinyl monomer is emulsified in an aqueous solution containing the surfactant of the present invention and polymerization initiator is added thereto start the polymerization, whereby a stable aqueous dispersion with a fine grain size can be obtained.

The surfactants of the present invention are especially useful when used together with the fluorine series cationic surfactant described in U.S. Pat. No. 3,850,642 and Japanese Patent Application (OPI) No. 146248/82 or the cation polymer described in Japanese Patent Application (OPI) No. 7763/80.

The photographic light-sensitive materials of the present invention are especially effective when processed by an economical process using a reduced amount of the rinsing water or using a reduced amount of the replenisher, and these are more particularly effective when processed by a combined rapid and simple process using a bleach or bleach-fixation solution containing a bleaching accelerator.

As the hydrophilic colloid to be used as a binder in the present invention, gelatin is generally used, but other hydrophilic colloids can also be used.

For example, there are proteins such as gelatin derivatives, graft polymers of gelatin and other polymers, albumin, casein, etc.; cellulose derivatives such as hdroxyethyl cellulose, carboxymethyl cellulose, cellulose sulfates, etc; saccharose derivatives such as sodium alginate, starch derivatives, etc.; and various synthetic hydrophilic homopolymers or copolymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As gelatin, conventional lime-processed gelatin as well as acid-processed gelatin or the enzyme-processed gelatin such as described in *Journal of the Society of Photographic Science and Technology of Japan, No.* 16, p. 30 (1966) can also be used. Also, the hydrolyzed products of gelatin can be used.

The "coupler" means a compound capable of forming a dye by a coupling reaction with the oxidation product of an aromatic primary amine developing agent. Specific examples of the couplers useful in the present invention include naphthol or phenol type compounds, pyrazolone or pyrazoloazole type compound and ring-opened or heterocyclic ketomethylene compounds.

A compound which can imagewise release a nucleating agent or a development accelerating agent or a precursor thereof (hereinafter referrd to as "accelerating agent, etc.") during development can also be used. Specific examples of such compounds are described in British Patent Nos. 2,097,140 and 2,131,188, which include DAR couplers capalbe of releasing a development accelerator, etc. by a coupling reaction with the oxidation product of an aromatic primary amine developing agent.

It is preferred that the development accelerator, etc., released from the DAR coupler has an adsorbing group which can adsorb to a silver halide, and specific examples of such couplers are described in Japanese Patent Application (OPI) Nos. 157638/84 and 170840/84.

DAR couplers capable of forming an N-acyl-substituted hydrazine compound having a mono-heterocyclic or condensed-heterocyclic adsorbing group, which is released from the coupling active position of the coupler via a sulfur atom or a nitrogen atom, are especially preferred, and specific examples of such couplers are described in Japanese Patent Application (OPI) No. 128446/75 corresponding to EP-147765A2.

The compounds having a development accelerator moiety in the coupler residue, described in Japanese Patent Application (OPI) No. 37556/85; or the compounds capable of releasing a development accelerator by an oxidation-reduction reaction with a developing agent, described in Japanese Patent Application (OPI) No. 107029/85 can also be used in the photographic light-sensitive materials of the present invention.

The DAR coupler is prederably introduced into the light-sensitive silve halide emulsion layer of the photographic light-sensitive material of the present invention, and it is also preferred to incorporate substantially non-light-sensitive silver halide grains into at least one photographic constituting layer of the material, as described in Japanese Patent Application (OPI) Nos. 172640/84 and 128429/85.

The materials of the present invention may also contain, as a color fog inhibitor or a color mixing preventing agent, hydroquinone derivatives, aminophenol derivatives, amines, gallic acid derivatives, catechol derivatives ascorbic acid derivatives, colorless couplers, sulfonamidophenol derivatives, etc.

Known anti-fading agents can be used as an oil drop-forming substance in the present invention. Specific examples of known anti-fading agents include hindered phenols such as hydroquinones, 6-hydroxychromans, 5-hdroxycoumarans, spirochromans, p-alkoxyphenols, bisphenols, etc.; gallic acid derivatives, methylenedioxybenzenes, aminophenols and hindered amines; and ether or ester derivatives of the above-described compounds where the phenolic hdroxyl group is silylated or alkylated. In addition, metal complexes such as (bis-salicylaldoximato)nickel complexes and (bis-N,N-dialkyldithiocarbamato)nickel complexes can also be used.

An ultraviolet absorbent can be added to the hydrophilic colloid layer of the material of the present invention. For example, the aryl-substituted benzotriazoles described in U.S. Pat. Nos. 3,553,794 and 4,236,013, Japanese Patent Publication No. 6540/76, European Patent No. 57,160, etc.; the butadienes described in U.S. Pat. Nos. 4,450,229 and 4,195,999, etc.; the cinnamates described in U.S. Pat. Nos. 3,705,805 and 3,707,375, etc.; the benzophenones described in U.S. Pat. No. 3,215,530, British Patent No. 1,321,355etc.; the polymer compounds having an utraviolet absorbing residue described in U.S. Pat. Nos. 3,761,272 and 4,431,726, etc. can be used. Also, the ultraviolet absorbing brightening agents described in U.S. Pat. Nos. 3,499,762 and 3,700,455, etc. can be used. Specific examples of ultraviolet absorbents are describede in *Research Disclosure*, (RD) No. 24239 (Jun., 1984), etc.

The oil-soluble dyes described in U.S. Pat. No. 4,420,555, Japanese Patent Application (OPI) No. 205934/86, etc., can also be used. Although these dyes are generally discolored in a developer and the decomposition products would precipitate in the processing solution, the formation of such precipitate can be prevented by the incorporation of the surfactant of the present invention into the photographic material, and so, the incorporation of the surfactant of the present invention is especially effective when the material contains such a dye.

Further, the materials of the present invention may also contain high boiling point organic solvents (oils), hydrophobic polymers, polymer latexes, etc., for dispersion of the above-metnioned hydrophobic additives can be formed into oil drops by means of various known dispersion methods. For example, specific examples of the methods include a solid dispersion method, more preferably an oil-in-water dispersion method, etc. According to the oil-in-water dispersion method, the additive is first dissovled either in a single solution comprising one of high boiling point organic solvents having a boiling point of 175° C. or higher and so-called auxiliary solvent having a low boiling point or in a mixture solution comprising both types of solvents, and then the resulting solution is finely dispersed in an aqueous medium such as water or an aqueous gelatin solution in the presence of the surfactant. Examples of the high boiling point organic solvents are described in U.S. Pat. No. 2,322,027. The dispersion may be accompanied by phase inversion. The auxiliary solvent as used may be removed or reduced by distillation, noodle washing or ultrafiltration prior to coating the resulting emulsion onto a support.

Any other known surfactants can be used in addition to the compounds of the formula (I) of the present invention.

Other surfactants include various kinds of coating aids, antistatic agents, slide property improving agents, emulsification and dispersion agents, anti-blocking agents and photographic characteristic improving agents (such as development accelerators, sensitizers, contrast enhancers, etc.). For example, specific examples of coating aids are described in B.M. Deryagin & S.M. Levi, *Film Coating Theory* (The Focal Press, 1974), pages 159—164, U.S. Pat. Nos. 4,242,444 and 4,547,459, Japanese Patent Application (OPI) Nos. 116799/80 and 209732/85, etc. Specific examples of antistatic agents are described in Swiss Patent No. 506,093, British Patent No. 1,417,915, Japanese Patent Application (OPI) Nos. 146248/82, 208743/83 and 143750/86, etc. Most of the antistatic compounds described in these publications also have the effects of an anti-blocking agent or a slide property improving agent. As the emulsification and dispersion agent, the above-mentioned surfactants which are used as a coating aid can be used, and in addition, the compounds described in Japanese Patent Publication No. 9979/73, Japanese Patent Application (OPI) Nos. 66230/75, 129229/76, 138726/78, 99416/79 and 153933/80, etc. can typically be used. As the photographic characteristic improving agent, the compounds described in K. Eda, *Study of Surfactants*, "2-H. Application in Photography" (by Saiwai Shobo, 1973), pages 384—391 are typical.

The above-mentioned compounds are merely typical and illustrate the unlimited range of surfactants which may be employed. Any commercial surfactants can be utilized in accordance with various objects in the present invention. Accordingly, the above-illustrated examples are not limitative.

Any silver halide, including silver bromide, silver iodobromide, silver iodochlorobromide, silver chlorobromide and silver chloride, can be used in the photographic emulsion layers of the photographic light-sensitive materials of the present invention. Preferred silve halides are a silver iodobromide or a silver idochlorobromide containing 30 mol% or less silver iodide. An especially preferred one is a silver iodobromide containing from 2 mol% to 25 mol% of silver iodide.

The silver halide grains in the photographic emulsion may be so-called regular grains having a regular crystal form such as cubic, octanhedral of tetradecahedral grains, or may be irregular grains having an irregular crystal form such as spherical grains or those having a crystal defect such as twin plane, etc., or may also be composite grains having a composite form of these crystal forms.

The silver halide grains may be fine grains having a grain size of 0.1 μ or less or may be large grains having a grain size, as diameter of the projected area, of up to 10 μ. The silver halide emulsion may be either a monodispersed one having a narrow grain size distribution or a polydispersed one having a broad grain size distribution.

The photographic emulsions for use in the present invention can be prepared using the methods described in P. Glafkides, *Chimie et Physique Photographique* (published by Paul Montel, 1967); G.F. Duffin, *Photographic Emulsion Chemistry* (published by Focal Press, 1966); V.L. Zelikman et al, *Making and Coating Photographic Emulsion* (published by Focal Press, 1964), etc.

For example, the silver halide emulsions may be prepared by an acid method, a neutralization method, an ammonia method, etc. Also, as a method of reacting a soluble silver salt and soluble halide(s), a single jet method, a double jet method, or a combination thereof may be used. A so-called reverse mixing method capable of forming silver halide grains in the presence of excessive silver ions can also be employed. As one system of the double jet method, a so-called controlled double jet method of keeping a constant pAg in a liquid phase while forming silver halide grains can also be employed. When the double jet method is used, a silver halide emulsion containing silver halide grains having a regular crystal form and almost uniform grain sizes can be obtained.

Two or more kinds of silver halide emulsion which are prepared separately can be blended for use in the present invention.

Examples of known photographic additives which can be used in the present invention are described in Research Disclosure RD Nos. 17643 (1978) and 18716 (1979), and the relevant parts therein are summarized below.

| No. | Additives | RD 17643 | RD 18716 |
|---|---|---|---|
| 1. | Chemical Sensitizer | p. 23 | p. 648, right column |
| 2. | Sensitivity Enhancer | | " |
| 3. | Spectral Sensitizer<br>Super Color Sensitizer | pp. 23–24 | from p. 648, right column to p. 649, right column |
| 4. | Brightening Agent | p. 24 | |
| 5. | Anti-foggant Stabilizer | pp. 24–25 | p. 649, right column |
| 6. | Light Absorbent Filter<br>Dye UV Absorbent | pp. 25–26 | from p. 649, right column to p. 650, left comumn |
| 7. | Stain Inhibitor | p. 25, right column | p. 650, from left to right column |
| 8. | Color Image Stabilizer | p. 25 | |
| 9. | Hardener | p. 26 | p. 650, left column |
| 10. | Binder | p. 26 | " |
| 11. | Plasticizer, Lubricant | p. 27 | p. 650, right column |
| 12. | Coating Aid Surfactant | pp. 26–27 | " |

-continued

| No. | Additives | RD 17643 | RD 18716 |
|---|---|---|---|
| 13. | Antistatic Agent | p. 27 | " |

The photographic emulsion layer of the photographic light-sensitive materials of the present invention can contain, for the purpose of sensitivity enhancement, contrast elevation or development acceleration, for example, polyalkylene oxides or their ether, ester or amine derivatives, as well as thioether compounds, thimorpholines, quaternary ammonium salt compounds, urethane derivatives, urea derivatives, imidazole drivatives, 3-pyrazolidones, etc. For instance, the compounds described in U.S. Pat. Nos. 2,400,532, 2,423,549, 2,176,062, 3,617,280, 3,772,021 and 3,808,003, British Patent No. 1,488,991, etc. can be used.

The silver halide photographic emulsions for use in the present invention may contain various compounds for the purpose of preventing fog and of stabilizing the photographic characteristics of the photographic materials during the manufacture, storage or photographic processing of the materials. For example, a lot of compounds which are known as an anti-foggant agent or a stabilizing agent can be used for this purpose, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercatothiadiazoles, aminotriazoles, benzotriazoles, nitrobenzotriazoles, mercaptotetrazoles (especially 1-phenyl-qb 5-mercaptotetrazole), etc.; mercaptopyrimidines; mercaptotriazines; thioketo compounds such as ocazolinethione, etc.; azaindenes such as triazaindenes, tetrazaindenes (especially 4-hydroxy-substituted (1,3,3a,7)-tetrazaindiens), pentazaindenes, etc.; benzenthiosulfonic acid, benzenesulfinic acid, benzenesulfonic acid amide, etc.

The photographic light-sensitive materials of the present invention may contain a water-soluble dye in the hydrophilic colloid layer, as filter dye or for the purpose of anti-irradiation or anti-halation or for any other various purposes. As such dyes, oxonole dyes, hemioxonole dyes, styryl dyes, merocyanine dyes, anthraquinone dyes and azo dyes are preferably used, and, in addition, cycanine dyes, azomethine dyes, triarylmethane dyes and phthalocyanine dyes are also useful.

The photographic light-sensitive materials of the present invention may contain an inorganic or organic hardener in the photographic light-sensitive layer or in any hydrophiclic colloid layer to consitute the backing layer. For example, chromium salts, aldehydes (formaldehyde, glyoxal, glutaraldehyde, etc.) and N-methylol series compounds (dimethylolurea, etc.) are mentioned as specific examples of hardeners. Active halogen compounds (2,4-dichloro-6-hydroxy-1,3,5-triazine, etc.) and active vinyl compounds (1,3-bisvinylsulfonyl-2-propanol, 1,2-bisvinylsulfonylacetamidoethane or vinyl series polymers having a vinylsulfonyl group in the side chain, etc.) are preferred, as they can rapidly harden hydrophilic colloids such as gelatin to give a stable photographic characteristic to the photographic material. N-carbamoyl pyridinium salts and haloamidinium salts are also preferred, as the hardening speed of these salts is high.

The present invention can be applied to multilayer multicolor photographic light-sensitive materials having at least two layers, each having different spectral sensitivities, on a support. Multilayer natural color photographic materials have, in general, at least one red-sensitive emulsion layer, at least one green-sensitive emulsion layer and at least one blue-sensitive emulsion layer on a support. The order of these layers on the support is not limitative, but may freely be determined in accordance with the use of the material.

One preferred order of the layers comprises resensitive layer, green-sensitive layer and blue-sensitive layer in this order from the side of the support.

Any desired emulsion layer having the same color sensitivity may comprise two or more layers each having a different degree of sensitivity, so as to improve the final sensitivity of the material, or may further comprise three or more layers, each having a different degree of sensitivity, so as to improve the graininess.

In addition, a non-light-sensitive layer can exist between two or more emulsion layers having the same color-sensitivity.

Further, the material may also have a constitution where an emulsion layer having a different color-sensitivity is inserted between other emulsion layers each having the same color-sensitivity.

The multilayer multicolor photographic light-sensitive material may also have a filter layer capable of absorbing light having a determined wavelength or a layer for anti-halation. These light-absorbing layers can contain the above-mentioned organic dyes as well as colloidal silver grains.

For the purpose of improving the sensitivity by reflection of light or by trapping of a development inhibitor, a non-light-sensitive fine silver halide grains-containing emulsion can be used in one or more non-light-sensitive layers in the multilayer multicolor photographic light-sensitive material.

In general, a cyan-forming coupler is incorporated into the red-sensitive emulsion layer, a magenta-forming coupler into the green-sensitive emulsion layer and a yellow-forming coupler into the blue-sensitive emulsion layer, but any other combination can also be employed, as the case may be. For example, an infrared-sensitive layer can be combined with any of the above-mentioned layers, to provide a pseudo color photographic material for a light-sensitive material for semiconductor laser exposure. Further, a coupler which colors in a different color than the coupler to color in the complementary color with the color-sensitive light wavelength of each layer can also be incorporated into the material so as to eliminate any unnatural coloration, as described in Japanese Patent Publication No. 3481/58.

For the manufacture of the photgraphic light-sensitive materials of the present invention, the photographic emulsion layers and other layers are coated on a support which is generally used in conventional photographic light-sensitive materials, for example, a flexible support such as plastic film, paper, cloth, etc., or a rigid support such as glass, ceramic, metal, etc. Examples of useful flexible supports include semi-synthetic or synthetic polymer films such as films of cellulose nitrate, cellulose acetate, cellulose acetate-butyrate, polystyrene, polyvinyl chloride, polyethylene terephthalate, polycarbonate, etc., and papers coated or laminated with a baryta layer or a layer of an $\alpha$-olefin polymer (such as polyethylene, polypropylene, ethylene/butene copolymer), etc. The support may be colored with dyes or pigments and may be blackened for the purpose of light-shielding.

The surface of the support is generally coated with a subbing layer so as to improve the adhesiveness with the photographic layers and other layers to be coated over the support. Prior to the provision of the subbing layer, the surface of the support can be pre-treated by glow discharge, corona discharge, ultraviolet irradiation, flame treatment, etc.

A gelatin layer can be formed on the back surface of the support so as to prevent the curling of the materials which would result from the environmental moisture fluctuation. The gelatin layer can contain grains of a dye, an ultravilet absorbent, a water-soluble polymer latex, a polymethyl methacrylate, a polyacrylic acid, etc. Further, the fluorine series cationic surfactant described in U.S. Pat. No. 3,850,642 and Japanes Patent Application (OPI) No. 146248/82 or the cation polymer described in Japanese Patent Application (OPI) No. 7763/80 can also be coated on the back surface of the support, together with the gelatin or in place of the gelatin, for the purpose of static charge prevention.

For coating the photographic emulsion layers and other hydrophilic colloid layers, various known coating methods can be utilized, for example, including a dip coating method, roller coating method, air knife coating method, curtain coating method, extrusion coating method, etc. If desired, plural layers can be coated simultaneously by the coating method described in U.S. Pat. Nos. 2,681,294, 2,768,791, 3,526,528 and 3,508,947, etc.

In particular, the multi-slide coating method described in U.S. Pat. No. 2,761,791 and the curtain coating method described in Japanese Patent Publication Nos. 35447/74, 3100/78 and 24133/74, etc. are especially advantageous for the present invention.

The photographic light-sensitive materials of the present invention can be exposed by various exposing means. Any desired light source capable of radiating a radiation corresponding to the sensitivity wavelength of the photographic light-sensitive material to be exposed can be used as an illuminating light source or as a writing light source. For example, natural light (sun light), incandescent light, a halogen lamp, a mercury lamp, a fluorescent lamp and flash light sources such as a strobe or metal flaming flash bulb, etc., are generally used as the light source for expsoure. A gas, dye solution or semiconductor laser which emits in the wavelength range of from the ultra-violet to the infrared range, as well as a light-emitting diode and a plasma light source, can also be used as a recording light source.

Further, an exposing means comprising a combination of a micro-shutter array which utilizes a fluorescent plane (CRT, etc.) as emitted from a fluroescent substance excited by an electron ray, etc., a liquid crystal (LCD), a lanthanum-doped titanium lead zirconate (PLZT), etc., and a linear or plane light source can also be used. If desired, the spectral distribution for exposure can be adjusted by the use of a color filter.

When the photographic light-sensitive materials of the present invention are photographically processed, known methods for black-and-white development or color development can be utilized, and known processing solutions can also be used. The processing temperature si generally selected from the range between 18° C. and 50° C., but the temperature may be lower than 18° C. or may be higher than 50° C. In accordance with the object of the present invention, the materials can be applied to color photographic processing including color development for formation of color images.

The color developer to be used for color development of color photographic light-sensitive materials is preferably an alkaline aqueous solution consisting essentially of an aromatic primary amine series color developing agent. As the color developing agent, p-phenylenediamine series compounds are preferably used, although aminophenol series compounds are also useful. Specific examples of such compounds include 3-methyl-4-amino-N,N-deithylaniline, 3-methyl-4-amino-N-ethyl-N-β-hydroxyethylaniline, 3-methyl-4-amino-N-ethyl-N-β-methanesulfonamidoethylaniline, 3-methyl-4 -amino-N-ethyl-N-β-methoxyethylaniline and sulfates, hydrochlorides or p-toluenesulfonates thereof. These diamines are generally more stable in the form of a salt than in the free state and, therefore, their salts are preferably used.

The color developer generally contains a pH buffer such as alkali metal carbonates, borates or phosphates, or a development inhibitor or an anti-foggan such as bromides, iodides, benzimidazoles, benzothiazoles or mercapto compounds, etc.

If desired, a preservative such as hyroxylamine or sulfites; an organic solvents such as triethanolamine or diethylene .glycol; a development accelerator such as benzyl alcohol, polyethylene glycol, quaternary ammonium salts or amines; a dye-forming coupler; a competing coupler; a nucleating agent such as sodium boron hydride; an auxiliary developing agent such as 1-phenyl-3-pyrazolidone; a tackifier; various kinds of chelating agents such as aminopolycarboxylic acids, aminopolyphosphonic acids, alkylphosphonic acids, phosphonocarboxylic acids, etc.; The antioxidant described in West German Patent Application (OLS) No. 2,622,950, etc., can also be added to the color developer.

For development of color reversal photographic materials, color development generally follows black-and-white development. As the black-and-white developer, known black-and-white developing agents, for example, dihyroxybenzenes such as hydroquinone, etc., 3-pyrazolidones such as 1-phenyl-3-pyrazolidone, etc. or aminophenols such as N-methyl-p-aminphenol, etc., can be used singly or in combination.

After color development, the photographic emulsion layers are generally bleached. The bleaching can be carried out simultaneously with fixation or separately therefrom. As the bleaching agent can be used, for example, compounds of poly-valent metals such as iron (III), cobalt (III), chromium (VI), copper (III), etc., peracids, quinones, nitroso compounds, etc. Specific examples of the bleaching agents include ferricyanides; bichromates; organic complexes of iron (III) or cobalt (III), for example, complexes with aminopolycarboxylic acids, such as ethylenediamine-tetraacetic acid, diethylenetriamine-pentaacetic acid, nitrilotriacetic acid, 1,3-diamino-2-propanol-tetraacetic acid, etc., or with organic acids such as citric acid, tartaric acid, malic acid, etc.; persulfates; manganates; nitrosophenol, etc. Among these bleaching agents, ethylenediaminetetraacetic acid iron (III) salt and persulfates are preferred from the viewpoint of rapid processability and less envrionmental pollution. Further, ethylenediamine-tetraacetic acid iron (III) complex is especially useful both in an independent bleaching solution or in combined bleach-fixing solution.

The bleaching solution or bleach-fixing solution can additionally contain various kinds of accelerators. For example, bromide ion and iodide ion, as well as the thiourea series compounds described in U.S. Pat. No. 3,706,561, Japanese Patent Publication Nos. 8506/70 and 26586/74, Japanese Patent Application (OPI) Nos. 32735/78, 36233/78 and 37016/78, etc.; the thiol series compounds described in Japanese Patent Application (OPI) Nos. 124424/78, 95631/78, 57831/78, 32736/78, 65732/78 and 52534/79, U.S. Pat. No. 3,893,858, etc.; the hterocyclic compounds described in Japanese Patent Application (OPI) Nos. 59644/74, 140129/75, 28426/78, 141623/78, 104232/78 and 35737/79, etc.; the thioether series compounds described in Japanese patent Application (OPI) Nos. 20832/77, 25064/80 and 26506/80, etc.; the tertiary amines described in Japanese Patent Application (OPI) Nos. 84440/73, etc.; the thiocarbamoyl compounds described in Japanese Patent Application (OPI) No. 42349/74, etc. can be used singly or in the form of a combination of two or more kinds of compounds.

The photographic light-sensitive materials of the present invention display a noticeable effect when the contain a bleaching accelerating agent described in Janpanese Patent Application (OPI) Nos. 95630/78 and 192953/82, Janpanese Patent Publication No. 12056/79, U.S. Pat. No. 4,552,834, etc., and/or when they are processed with a processing solution containing one of these bleaching accelerating agents.

As the fixing agent, there may be mentioned thiosulfates, thiocyanates, thioether series compounds, thioureas, a large amount of iodides, etc. The use of thiosulfates is conventional. As a preservative for the bleach-fixing solution or fixing solution, sulfites, bisulfites or carbonylbisulfite adducts are preferred.

The rinsing step is generally carried out after the fixation step or bleaching-fixation step.

The photographic light-sensitive materials of the present invention are particularly effective when they are processed by a multi-stage rinsing step in which the replenisher is replenished by a multi-stage countercurrent system, whereupon the amount of the replenisher is from 3 to 50 times of the amount of processing solution brought into the rinsing bath from the previous bath together with the photographic light-sensitive material being processed, per the unit area of said material.

The amount "amount of processing solution brought into the processing bath from the previous bath together with the photographic light-sensitive material being processed" means the volume of the processing solution of the previous bath clinging to and contained in the unit area of the photographic light-sensitive material being processed. For the calculation of this amount, the photographic light-sensitive material being processed is taken out just before being introduced into the very next bath and is immediately dipped in distilled water to extract the components of the processing solution of the previous bath, and the amounts of the thus extracted components are measured. For these measurements, highly stable components among those present in the previous bath which are not changed by oxidation, etc., during the extraction step are selected.

Various known compounds can be added to the rinsing solution for the purpose of prevention of sedimentation or of stabilization of the rinsing solution. For example, chelating agents such as inorganic phosphoric acids, aminopolycarboxylic acids, organic aminopolyphosphonic acids, etc.; various kinds of bactericides and fungicides for preventing propagation of bacteria, algae and fungi (e.g., the compounds described in *Journal of Antibacterial and Antifungal Agents*, Vol. 11, No. 5, pp.

207–223 (1983) and the compounds described in H. Horiguchi, *Bactericidal and Fungicidal Chemistry*); metal salts such as magnesium salts, aluminum salts, bismuth salts, as well as alkali metal salts and ammonium salts; and various kinds of hardeners, etc., can be added, if desired. Further, the compounds described in *Photographic Science and Engineering*, Vol. 6, pp, 344–359 (1965), etc., can also be added. In particular, the addition of chelating agents, bactericides and fungicides is effective.

The rinsing step may be carried out by a multistage countercurrent rinsing system using two or more tanks (for example, 2 to 9 tanks), so as to economize the amount of the rinsing water used. Further, a multistage countercurrent rinsing and stabilization step can also be carried out in place of the rinsing-in-water step, as described in Japanese patent application (OPI) No. 8543/82.

Various kinds of compounds are added to the rinsing and stabilization bath to be used in said step, so as to stabilize the images formed. For example, various kinds of buffers for adjusting the film pH of the photographic material being processed (for example, to pH of from 3 to 9), such as borates, metaborates, borax, phosphates, carbonates, potassium hydroxide, sodium hydroxide, aqueous ammonia, monocarboxylic acids, dicarboxylic acids, polycarboxylic acids, etc., which are used in pertinent combination, as well as aldehydes such as formalin, etc., are specific examples to be used for said purpose. In addition, other various kinds of additives, such as chelating agents (e.g., inorganic phosphoric acids, aminopolycarboxylic acids, organic phosphonic acids, aminopolyphosphonic acids, phosphonocarboxylic acids, etc.), bactericides (e.g., thiazole series compounds, isothiazole series comopounds, halogenated phenols, sulfanilamides, benzotriazoles, etc.), brightening agents, hardeners, etc., may also be added, and two or more compounds can be used together for the same or different purposes.

As a film pH adjusting agent for the materials processed, various kinds of ammonium salts such as ammonium chloride, ammonium nitrate, ammonium sulfate, ammonium phosphate, ammonium sulfite, ammonium thiosulfate, etc., are preferably added so as to improve the image storability of the material.

In addition, immediately after the rinsing step, a stabilizer bath can be used, containing a water-cutting agent and formalin. When a photographic light-sensitive material containing a 2-equivalent magenta coupler is processed, the formalin can be omitted or the stabilizer bath may not be used.

The rinsing time for processing the photographic light-sensitive materials of the present invention varies in accordance with the kind of photographic material and the processing conditions, but is generally from 20 seconds to 10 minutes, preferably from 20 seconds to 5 minutes.

The following examples are intended to illustrate the present invention, but are not intended to limit it in any way.

EXAMPLE 1

1 kg of a silver chlorobromide emulsion (containing 100 g of gelatin per mol of the silver halide), whose grains were formed and ripened in a conventional manner, was diluted to ⅓ with an aqueous 10% gelatin solution, and saponin was added to the resulting emulsion in an amount of 2 g per kg of the emulsion. Separately from this emulsion, an aqueous 5% gelation solution was prepared and an emulsion (mean grain size 0.9 μ) obtained by dispersing tri-n-hexyl phosphate in gelatin was added thereto obtain a solution containing tri-n-hexyl phosphate in an amount of 18 cc per kg of the aqueous 5% gelatin solution. The resulting solution was divided into ten equivalent parts, and the coating aid as shown in Table 1 below was added to each part in an amount of 1.0 g per kg of the aqueous 5% gelatin solution. Thus, ten kinds of coating compositions for surface protective layers were prepared.

The surface tension of each of the thus prepared protective layer coating compositions was measured with Wilhelmy's surface balance (for example, refer to E. Matijevis, *Surface and Colloid Science*, Vol. 1, pp. 124–128, Wiley-Interscience, 1969).

On the other hand, the emulsion and the surface protective layer coating compositions were simultaneously coated on a cellulose triacetate support by multi-slide method to form Sample Nos. 1 to 4. The number of comets per $m^2$ of each sample was measured.

The results obtained are shown in Table 1.

Measurement of Degree of Stain by Roller

An affect on the optical density of film samples (uneven density) caused by processing the films by stained rollers was determined. The samples having both the emulsion layer and the surface protective layer were cut into 30.5×17.1 cm square pieces. The resulting pieces were uniformly exposed to such a degree that the optical density after development was 1.0, and then 50 pieces thus exposed were continuously developed in an automatic developing machine (having a silicone roller conveyor) comprising a developing bath of Fuji Film's RD-II developer (35° C.), a fixing bath of Fuji Film's Fuji-F fixing agent (35° C.) and a rinsing-in-water bath.

After the rinsing squeegee roller was fully dried, a 51st sample was processed by the roller, and the appearance of the stripe-like density unevenness in the top edge of the 51st sample was examined.

The degree of stain of the sample was evaluated according to the following four ranks (A) to (D):

(A): No density unevenness.
(B): Slightly density unevenness.
(C): Some density unevenness.
(D): Extreme density unevenness.

The results obtained are shown in Table 1 below.

TABLE 1

| Sample No. | Coating Aid for Surface Protective Layer | | Surface Tension of Surface Protective Layer (mN/m) | Number of Comets (/$m^2$) | Roller Stain Degree |
|---|---|---|---|---|---|
| 101 (Comparison) | Compound A | 0.95 g/l | 30.4 | 183 | C |
| 102 (Comparison) | Compound B | " | 30.0 | 41 | C |
| 103 | Compound C | " | 29.8 | 57 | C |

TABLE 1-continued

| Sample No. | Coating Aid for Surface Protective Layer | | Surface Tension of Surface Protective Layer (mN/m) | Number of Comets (/m$^2$) | Roller Stain Degree |
|---|---|---|---|---|---|
| (Comparison) 104 | Compound D | " | 29.5 | 69 | D |
| (Comparison) 105 | Compound E | " | 28.4 | 40 | C |
| (Comparison) 106 | Compound F | " | 29.0 | 88 | D |
| (Comparison) 107 | Compound No. 2 of the Invention | 0.95 g/l | 26.5 | 21 | A |
| (The Invention) 108 | Compound No. 3 of the Invention | " | 26.0 | 10 | A |
| (The Invention) 109 | Compound No. 16 of the Invention | " | 27.3 | 0 | B |
| (The Invention) 110 | Compound No. 11 of the Invention | " | 27.7 | 8 | B |
| (The Invention) | | | | | |

Coating aids used for Sample Nos. 101 to 106 in Table 1 were as follows.

Compound A

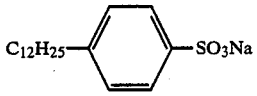

Compound B

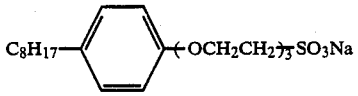

Compound C

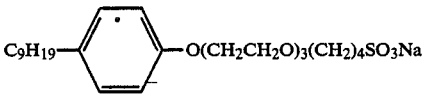

Compound D

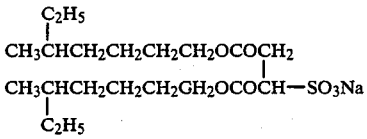

Compound E

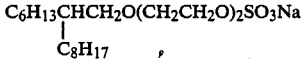

Compound F

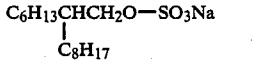

The results of Table 1 indicate that the samples using the compound of the present invention had few comets and hardly stained the roller (i.e., had a low roller stain degree).

EXAMPLE 2

A multilayer color photographic material was prepared by forming the layers having the composition shown below on a cellulose triacetate film support having a subbing layer.

The composition of the layers were as follows. The amount of silver halide and colloidal silver coated was represented by the units g/m$^2$ as silver. The coupler, other additives and gelatin were represented by the units g/m$^2$. The sensitizing dye was represented by the molar amount per mol of the silver halide in the same layer.

| | |
|---|---|
| First Layer: Anti-halation Layer | |
| Black Colloidal Silver | 0.5 |
| Gelatin | 1.3 |
| Colored Coupler C-1 | 0.06 |
| Ultraviolet Absorbent UV-1 | 0.1 |
| Ultraviolet Absorbent UV-2 | 0.2 |
| Dispersion Oil Oil-1 | 0.01 |
| Dispersion Oil Oil-2 | 0.01 |
| Desilving Accelerator BA-1 | 0.03 |
| Surfactant SA-2 | 0.01 |
| Second Layer: Interlayer | |
| Fine Silver Bromide Grains (mean grain size: 0.07μ) | 0.15 |
| Gelatin | 1.0 |
| Colored Coupler C-2 | 0.02 |
| Dispersion Oil Oil-1 | 0.1 |
| Surfactant SA-2 | 0.01 |
| Third Layer: First Red-Sensitive Emulsion Layer | |
| Silver Iodobromide Emulsion (silver iodide: 2 mol %; mean grain size: 0.3μ) | 0.4 as Ag |
| Gelatin | 0.6 |
| Sensitizing Dye I | $1.0 \times 10^{-4}$ |
| Sensitizing Dye II | $3.0 \times 10^{-4}$ |
| Sensitizing Dye III | $1.0 \times 10^{-4}$ |
| Coupler C-3 | 0.06 |
| Coupler C-4 | 0.06 |
| Coupler C-8 | 0.04 |
| Coupler C-2 | 0.03 |
| Dispersion Oil Oil-1 | 0.03 |
| Dispersion Oil Oil-3 | 0.012 |
| Surfactant SA-1 | 0.02 |
| Fourth Layer: Second Red-Sensitive Emulsion Layer | |
| Silver Iodobromide Emulsion (silver iodide: 5 mol %; mean grain size: 0.5μ) | 0.7 |
| Gelatin | 2.5 |
| Sensitizing Dye I | $1.0 \times 10^{-4}$ |
| Sensitizing Dye II | $3.0 \times 10^{-4}$ |
| Sensitizing Dye III | $1.0 \times 10^{-4}$ |
| Coupler C-3 | 0.24 |
| Coupler C-4 | 0.24 |
| Coupler C-8 | 0.04 |
| Coupler C-2 | 0.04 |
| Dispersion Oil Oil-1 | 0.15 |
| Dispersion Oil Oil-3 | 0.02 |
| Surfactant SA-1 | 0.05 |
| Fifth Layer: Third Red-Sensitive Emulsion Layer | |
| Silver Iodobromide Emulsion (silver iodide: 10 mol %; mean grain size: 0.7μ) | 1.0 as Ag |
| Gelatin | 1.0 |
| Sensitizing Dye I | $1.0 \times 10^{-4}$ |
| Sensitizing Dye II | $3.0 \times 10^{-4}$ |
| Sensitizing Dye III | $1.0 \times 10^{-4}$ |
| Coupler C-6 | 0.05 |
| Coupler C-7 | 0.1 |
| Dispersion Oil Oil-1 | 0.01 |
| Dispersion Oil Oil-2 | 0.05 |
| Surfactant SA-1 | 0.01 |

-continued

| | |
|---|---|
| Sixth Layer: Interlayer | |
| Gelatin | 1.0 |
| Compound Cpd-A | 0.03 |
| Dispersion Oil Oil-1 | 0.05 |
| Surfactant SA-2 | 0.02 |
| Seventh Layer: First Green-Sensitive Emulsion Layer | |
| Silver Iodobromide Emulsion (silver iodide: 4 mol %; mean grain size: 0.3μ) | 0.30 as Ag |
| Sensitizing Dye IV | $5.0 \times 10^{-4}$ |
| Sensitizing Dye VI | $0.3 \times 10^{-4}$ |
| Sensitizing Dye V | $2.0 \times 10^{-4}$ |
| Gelatin | 1.0 |
| Coupler C-9 | 0.28 |
| Coupler C-5 | 0.03 |
| Coupler C-1 | 0.03 |
| Dispersion Oil Oil-1 | 0.5 |
| Surfactant SA-1 | 0.04 |
| Eighth Layer: Second Green-Sensitive Emulsion Layer | |
| Silver Iodobromide Emulsion (silver iodide: 5 mol %; mean grain size: 0.5μ) | 0.4 as Ag |
| Gelatin | 0.8 |
| Sensitizing Dye IV | $5.0 \times 10^{-4}$ |
| Sensitizing Dye V | $2.0 \times 10^{-4}$ |
| Sensitizing Dye VI | $0.3 \times 10^{-4}$ |
| Coupler C-9 | 0.25 |
| Coupler C-1 | 0.03 |
| Coupler C-10 | 0.015 |
| Coupler C-5 | 0.01 |
| Dispersion Oil Oil-1 | 0.2 |
| Surfactant SA-1 | 0.01 |
| Ninth Layer: Third Green-Sensitive Emulsion Layer | |
| Silver Iodobromide Emulsion (silver iodide: 6 mol %; mean grain size: 0.7μ) | 0.85 as Ag |
| Gelatin | 1.0 |
| Sensitizing Dye VII | $3.5 \times 10^{-4}$ |
| Sensitizing Dye VIII | $1.4 \times 10^{-4}$ |
| Coupler C-11 | 0.01 |
| Coupler C-12 | 0.03 |
| Coupler C-13 | 0.24 |
| Coupler C-1 | 0.02 |
| Coupler C-15 | 0.02 |
| Dispersion Oil Oil-1 | 0.24 |
| Dispersion Oil Oil-2 | 0.05 |
| Surfactant SA-1 | 0.03 |
| Tenth Layer: Yellow Filter Layer | |
| Gelatin | 1.2 |
| Yellow Colloidal Silver | 0.08 |

-continued

| | |
|---|---|
| Compound Cpd-B | 0.1 |
| Dispersion Oil Oil-1 | 0.3 |
| Surfactant SA-2 | 0.04 |
| Eleventh Layer: First Blue-Sensitive Emulsion Layer | |
| Monodispersed Silver Iodobromide Emulsion (silver iodide: 4 mol %; mean grain size: 0.7μ) | 0.4 as Ag |
| Gelatin | 1.0 |
| Sensitizing Dye IX | $2.0 \times 10^{-4}$ |
| Coupler C-14 | 0.9 |
| Coupler C-5 | 0.07 |
| Dispersion Oil Oil-1 | 0.2 |
| Surfactant SA-1 | 0.04 |
| Twelfth Layer: Second Blue-Sensitive Emulsion Layer | |
| Silver Iodobromide Emulsion (silver iodide: 10 mol %; mean grain size: 1.5μ) | 0.5 as Ag |
| Gelatin | 0.6 |
| Sensitizing Dye IX | $1.0 \times 10^{-4}$ |
| Coupler C-14 | 0.25 |
| Dispersion Oil Oil-1 | 0.07 |
| Surfactant SA-1 | 0.03 |
| Thirteenth Layer: Protective Layer | |
| Gelatin | 0.8 |
| Ultraviolet Absorbent UV-1 | 0.1 |
| Ultraviolet Absorbent UV-2 | 0.2 |
| Dispersion Oil Oil-1 | 0.01 |
| Dispersion Oil Oil-2 | 0.01 |
| Surfactant SA-3 | 0.04 |
| Fourteenth Layer: Second Protective Layer | |
| Fine Silver Bromide Grains (mean grain size: 0.07μ) | 0.5 |
| Gelatin | 0.45 |
| Polymethyl Methacrylate Grains (diameter: 1.5μ) | 0.2 |
| Hardener H-1 | 0.4 |
| Formaldehyde Scavenger S-1 | 0.5 |
| Formaldehyde Scavenger S-2 | 0.5 |
| Surfactant SA-4 | 0.01 |
| Surfactant SA-5 | 0.05 |
| Surfactant SA-6 (Antistatic Agent) | 0.02 |

The sample thus prepared was designated as Sample (201).

Chemical structural formulae or chemical names of the compounds used in Example 2 are mentioned below. UV-1:

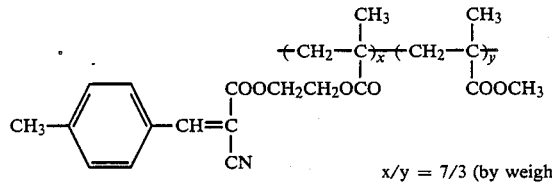

UV-1 x/y = 7/3 (by weight)

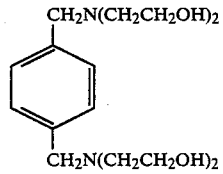

BA-1

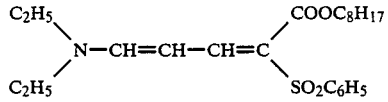

UV-2

| | |
|---|---|
| Tricresyl Phosphate | Oil-1 |
| Dibutyl Phthalate | Oil-2 |
| Bis(2-ethylhexyl) Phthalate | Oil-3 |

-continued
C-1
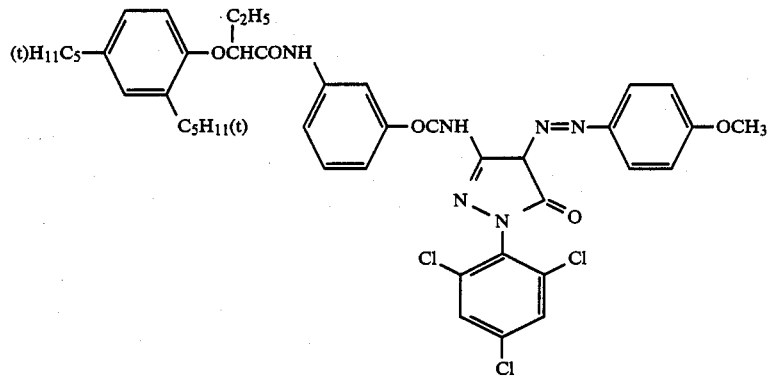
C-2
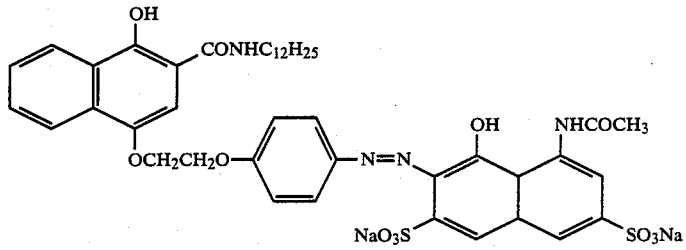
C-3
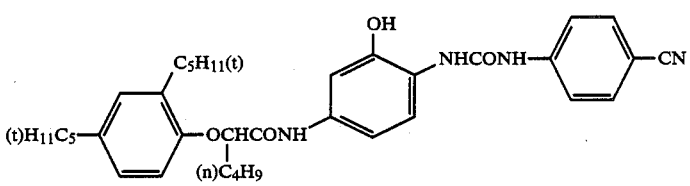
C-4
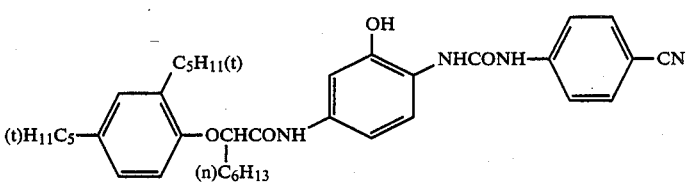
C-5
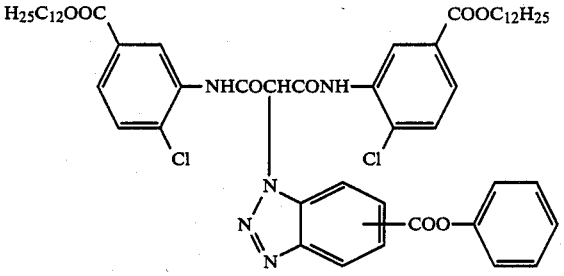
C-15
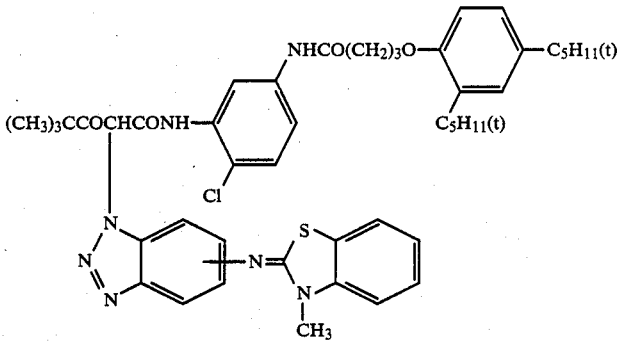

-continued
C-6
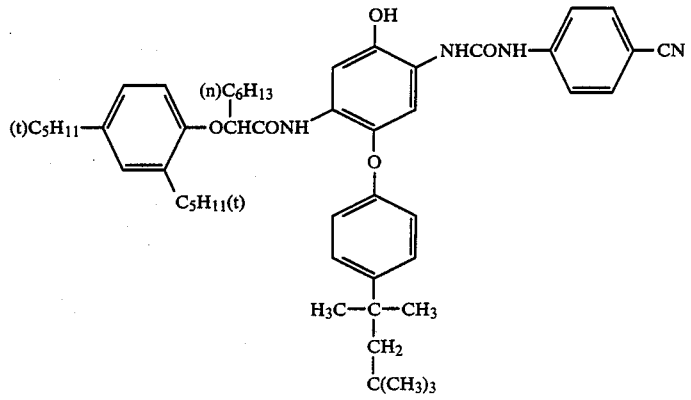
C-7
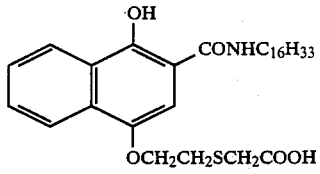
C-8
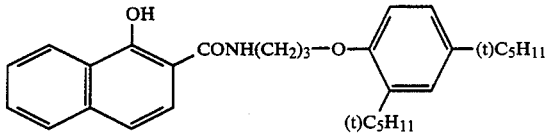
C-9
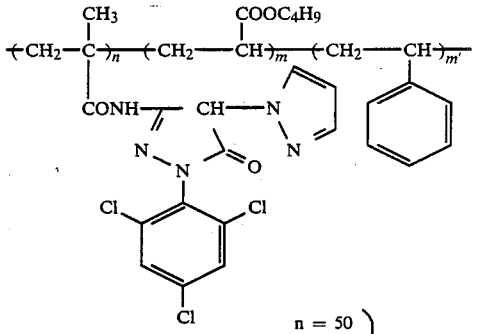
n = 50
m = 25 } weight ratio
m' = 25
Molecular Weight: about 20,000
C-10
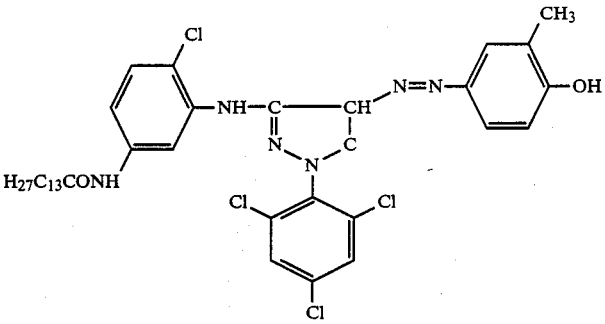

-continued
C-11
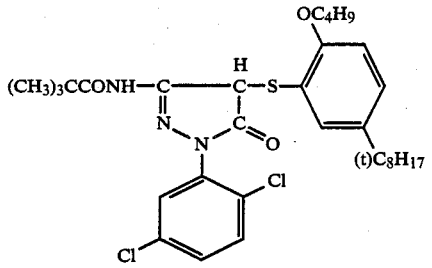
C-12
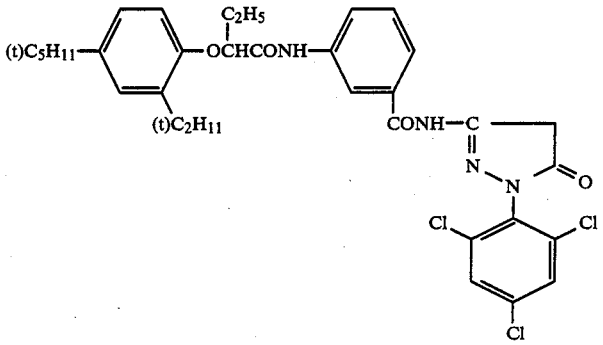
C-13
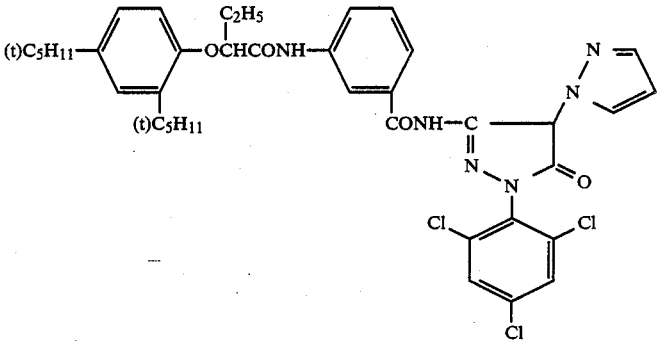
C-14
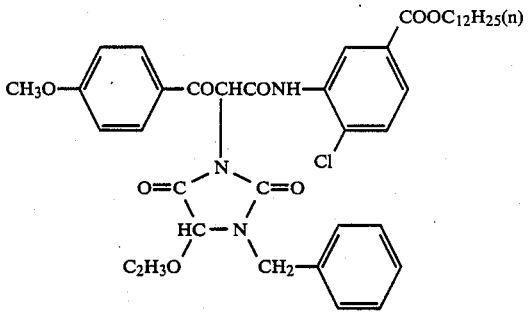
Compound A
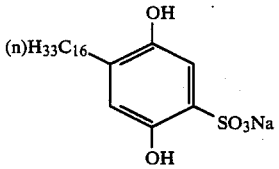
Compound B
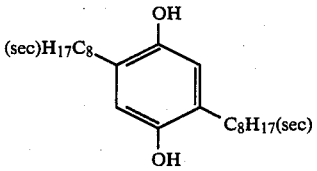

-continued
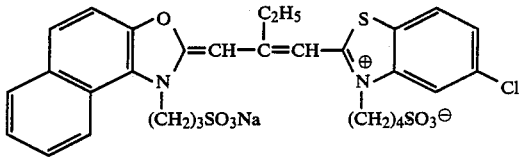
Sensitizing Dye I
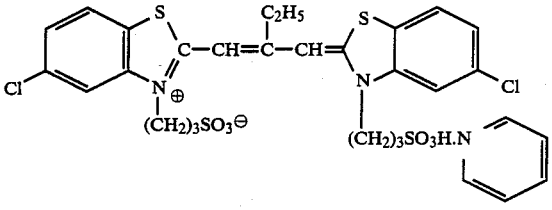
Sensitizing Dye II
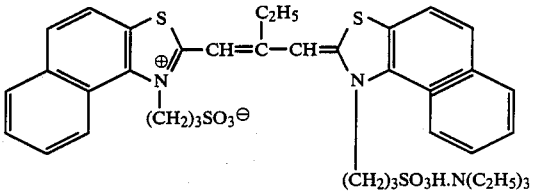
Sensitizing Dye III
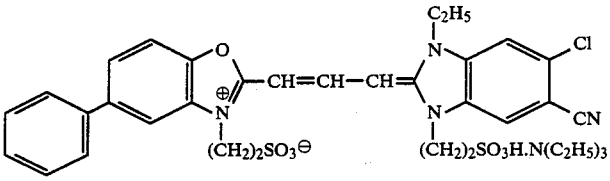
Sensitizing Dye IV
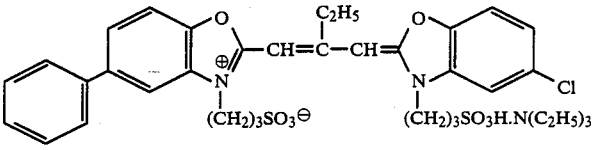
Sensitizing Dye V
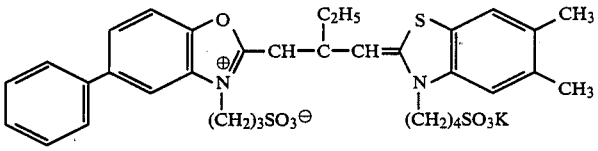
Sensitizing Dye VI
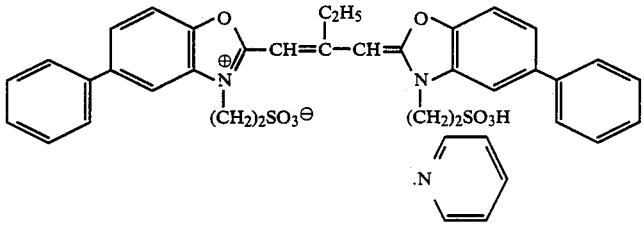
Sensitizing Dye VII
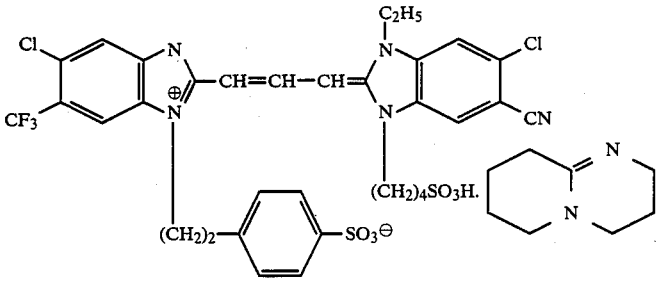
Sensitizing Dye VIII -continued

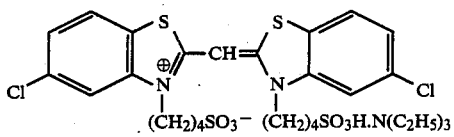

Sensitizing Dye IX

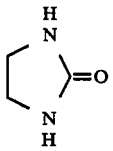

S-2

$CH_2{=}CH{-}SO_2{-}CH_2{-}CONH{-}CH_2$
$CH_2{=}CH{-}SO_2{-}CH_2{-}CONH{-}CH_2$

H-1

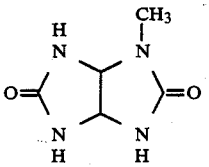

S-1

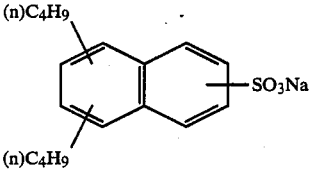

SA-1

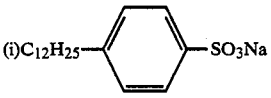

SA-2

$CH_3(CH_2)_{10}CH{=}CHCH_2SO_3Na$

SA-3

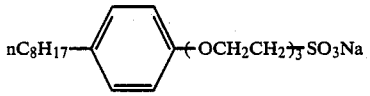

SA-4

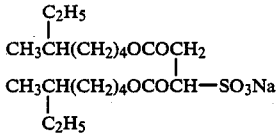

SA-5

$C_8F_{17}SO_2N(C_3H_7)CH_2COOK$

SA-6

$C_8F_{17}SO_2NHCH_2CH_2CH_2OCH_2CH_2\overset{\oplus}{N}(CH_3)_3$

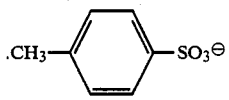

SA-7

Preparation of Sample (202)

Sample (202) was prepared in the same manner as the preparation of Sample (201), except that the Surfactant (anti-static agent) SA-6 in the fourtheenth layer of Sample (201) was replaced by Fluorine Series Cationic Surfactant SA-7.

Preparation of Sample (203)

Sample (203) was prepared in the same manner as the preparation of Sample (201), except that the Surfactants SA-4 and SA-5 in the fourtheenth layer of Sample (201) were replaced by the same amount (total of SA-4 and SA-5) of Compound No. 16 of the present invention.

Preparation of Sample (204)

Sample (204) was prepared in the same manner as the preparation of Sample (201), except that the Surfactants SA-4 and SA-5 in the fourtheenth layer of Sample (202)

were replaced by the same amount (total of SA-4 and SA-5) of Compound No. 16 of the present invention.

Preparation of Sample (205)

Sample (205) was prepared in the same manner as the preparation of Sample (202), except that the Surfactants SA-4 and SA-5 in the fourtheenth layer of Sample (202) were replaced by the same amount (total of SA-4 and SA-5) of Compound No. 10 of the present invention.

The coating compositions prepared above were all coated on a support at the same time by the multi-slide method, and the number of comets formed per $m^2$ of the coated sample was measured.

Next, the photographic elements thus prepared were exposed to a tungsten lamp of 25 CMS through a filter, the color temperature being adjusted to 4800° K., and then processed in an automatic developing machine in accordance with the following procedure.

TABLE 2

| Step | Time | Temperature | Tank Capacity | Amount of Replenisher* |
|---|---|---|---|---|
| Color Development | 3 min 15 sec | 38° C. | 18 liters | 38 ml |
| Bleaching | 6 min 30 sec | " | 36 liters | 18 ml |
| Fixation | 3 min 15 sec | " | 18 liters | 33 ml |
| Rinsing (1) | 1 min 30 sec | " | 9 liters | — |
| Rinsing (2) | 1 min 30 sec | " | 9 liters | 1300 ml |
| Stabilization | 40 sec | " | 9 liters | 33 ml |

*Amount of Replenisher per m of Sample with 35 mm width.

In the above process, rinsing was carried out by a countercurrent rinsing system from rinsing bath (2) to rinsing bath (1).

The compositions of the processing solutions used were as follows.

Color Developer

| | Tank Solution | Replenisher |
|---|---|---|
| Diethylenetriamine-pentaacetic Acid | 1.0 g | 1.0 g |
| 1-Hydroxyethylidene-1,1-diphosphonic Acid | 2.0 g | 2.2 g |
| Sodium Sulfite | 4.0 g | 4.4 g |
| Potassium Carbonate | 30.0 g | 32.0 g |
| Potassium Bromide | 1.4 g | 0.7 g |
| Potassium Iodide | 1.3 mg | — |
| Hydroxylamine Sulfate | 2.4 g | 2.6 g |
| 4-(N-ethyl-N-β-hydroxyethylamino)-2-methylaniline Sulfate | 4.5 g | 5.0 g |
| Water to make | 1 liter | 1 liter |
| pH | 10.00 | 10.05 |

Bleaching Solution

| | Tank Solution | Replenisher |
|---|---|---|
| Ammonium Ethylenediamine-tetraacetic Acid Ferric Complex | 100 g | 110 g |
| Ethylenediamine-tetraacetic Acid Disodium Salt | 10.0 g | 11.0 g |
| Aqueous Ammonia | 7 ml | 5 ml |
| Ammonium Nitrate | 10.0 g | 12.0 g |
| Ammonium Bromide | 150 g | 170 g |
| Water to make | 1 liter | 1 liter |
| pH | 6.0 | 5.8 |

-continued

Fixing Solution

| | Tank Solution | Replenisher |
|---|---|---|
| Ethylenediamine-tetraacetic Acid Disodium Salt | 1.0 g | 1.2 g |
| Sodium Sulfite | 4.0 g | 5.0 g |
| Sodium Bisulfite | 4.6 g | 5.8 g |
| Ammonium Thiosulfate (Aqueous Solution, 70 wt %) | 175 ml | 200 ml |
| Water to make | 1 liter | 1 liter |
| pH | 6.6 | 6.6 |

Rinsing Solution

City water was used.

Stabilizer Solution

| | Tank Solution | Replenisher |
|---|---|---|
| Formalin (37 wt % formaldehyde in water) | 2.0 ml | 3.0 ml |
| Polyoxyethylene-p-monononylphenyl Ether (mean polymerization degree: 10) | 0.3 g | 0.45 g |
| Water to make | 1 liter | 1 liter |

In the first place, the color photographic material sample (with 35 mm width) exposed as mentioned above was continuously processed in an automatic developing machine having the tank capacity mentioned in Table 2 above, in a length of 20 m per day, for 20 days.

The thus processed samples were designated as Sample (201-I) to (205-I), respectively.

Next, the other samples were processed in the same manner as the procedure of Table 2, except that Rinsing Solution II as mentioned below was used in rinsing steps (1) and (2) and the amount of the replenisher of the rinsing solution was reduced to 27 ml. After the same continuous processing for 20 days, the thus processed samples were designated as Samples (201-II) to (205-II).

Rinsing Solution II

| | Tank Solution | Replenisher |
|---|---|---|
| 2-Methyl-isothiazolin-3-one | 10 mg | 10 mg |
| 5-Chloro-2-methylisothiazolin-3-one | 10 mg | 10 mg |
| Water to make | 1 liter | 1 liter |
| Sodium Hydroxide to make | pH 7.0 | pH 7.0 |

The respective samples thus processed were examined as to the generation of the peeling static marks (fog by static sparks) by the roller which had been applied to the samples before being processed, and the processed density unevenness was evaluated by the same four-stage standard as in previous Example 1. Further, the surface stain of each of the processed samples was also evaluated on the basis of the three stages as mentioned below.

(A): No Stain.

(B): Somewhat Stained.

(C): Extreme Stain:

The results obtained are shown in Table 3 below.

TABLE 3

| Sample No. | Antistatic Agent in 14th Layer | Coating Aid in 14th Layer | Comets ($/m^2$) | Process | Rinsing Solution | Static Mark | Processed Density Unevenness | Surface Stain |
|---|---|---|---|---|---|---|---|---|
| 201 (Comparison) | SA-6 | SA-4 | 10 | I | Water | | C | A |
| | | SA-5 | | II | Rinsing | | | B |

TABLE 3-continued

| Sample No. | Antistatic Agent in 14th Layer | Coating Aid in 14th Layer | Comets (/m²) | Process | Rinsing Solution | Static Mark | Processed Density Unevenness | Surface Stain |
|---|---|---|---|---|---|---|---|---|
| | | | | | Solution II | | | |
| 202 | SA-7 | SA-4 | 86 | I | Water | | D | B |
| (Comparison) | | SA-5 | | II | Rinsing | | | C |
| | | | | | Solution II | | | |
| 203 | SA-6 | Compound | 0 | I | Water | | A | A |
| (The Invention) | | No. 16 | | II | Rinsing | | | A |
| | | | | | Solution II | | | |
| 204 | SA-7 | Compound | 0 | I | Water | | A | A |
| (The Invention) | | No. 16 | | II | Rinsing | | | A |
| | | | | | Solution II | | | |
| 205 | SA-7 | Compound | 3 | I | Water | | B | A |
| (The Invention) | | No. 10 | | II | Rinsing | | | B |
| | | | | | Solution II | | | |

The results of Table 3 indicate that the samples using the compound of the present invention had few comets, the processed density unevenness was minimized and surface stain was also minimized in the samples of the present invention. In addition, it is apparent that the combination of the compound of the present invention and the Antistatic Agent SA-7 resulted in the complete elimination of static marks.

While the invention has been described in detail and with reference to specific embodiments thereof, it will be apparent to one skilled in the art that various changes and modifications can be made therein without departing from the spirit and scope thereof.

What is claimed is:

1. A silver halide photographic element having at least one light-sensitive silver halide emulsion layer and at least one hydrophilic colloid layer on a support, and containing in the silver halide emulsion layer or in said hydrophilic colloid layer a compound of formula (I):

$$A—O—X—(B)_n—SO_3M \quad (I)$$

wherein

X represents $—(CH_2CH_2O)_a—(C_3H_6O)_b—$;

a represents 0 or from 1 to 50 on the average;

b represents from 1 to 5 on the average;

A represents an alkyl or alkenyl group having from 8 to 25 carbon atoms, or an aryl group;

B represents a divalent linking group;

n represents 0 or 1; and

M represents a cation;

wherein when n is 1, B in formula (I) represents a straight or branched chain alkylene or carbonylalkylene group, and wherein the amount of compound of formula (I) added to the layer is from 0.01 to 50 g per kg of the coating composition.

2. A silver halide photographic element as in claim 1, wherein A in the formula (I) represents $C_{12}H_{25}$—, $C_{16}H_{33}$—,

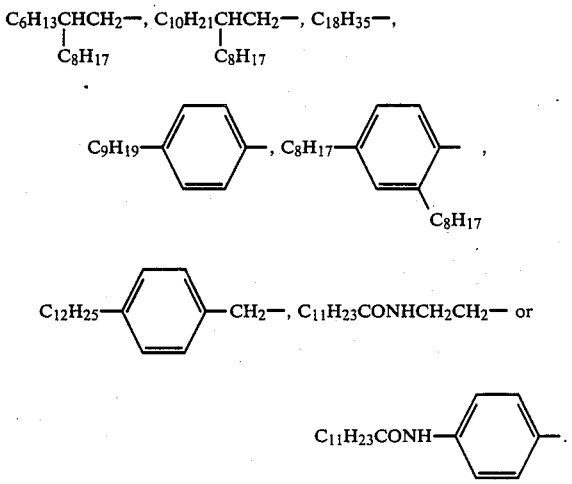

3. A silver halide photographic element as in claim 1, wherein M in the formula (I) represents an alkali metal, an alkaline earth metal, ammonium or quaternary amine cation.

4. A silver halide photographic element as in claim 1, wherein the amount of the compound of the formula (I) to be added to the layer is from 0.05 to 5 g per kg of the coating composition.

5. A silver halide photographic element as in claim 1, wherein A in the formula (I) represents a branched chain alkyl group.

* * * * *